US005791102A

United States Patent [19]

Sheath et al.

[11] Patent Number: 5,791,102

[45] Date of Patent: Aug. 11, 1998

[54] CRUCIFORM JOINT OF GLAZING BARS

[75] Inventors: Gary Sheath, 1A Roman Way, Bedhampton, Havant, Hants, United Kingdom; Colin Leslie Poynder, Hayling Island, United Kingdom

[73] Assignee: Gary Sheath, Hants, United Kingdom

[21] Appl. No.: 765,655

[22] PCT Filed: Jun. 23, 1995

[86] PCT No.: PCT/GB95/01472

§ 371 Date: Dec. 23, 1996

§ 102(e) Date: Dec. 23, 1996

[87] PCT Pub. No.: WO96/00340

PCT Pub. Date: Jan. 4, 1996

[30] Foreign Application Priority Data

| | | | |
|---|---|---|---|
| Jun. 23, 1994 | [GB] | United Kingdom | 9412613 |
| Feb. 20, 1995 | [GB] | United Kingdom | 9503249 |

[51] Int. Cl.[6] ..... E06B 1/04

[52] U.S. Cl. ..... 52/204.7; 52/667; 52/314; 52/456

[58] Field of Search ..... 52/667, 314, 456, 52/204.7

[56] References Cited

U.S. PATENT DOCUMENTS

| | | | |
|---|---|---|---|
| 3,469,359 | 9/1969 | Nagin . | |
| 3,678,651 | 7/1972 | Hicks | 52/456 X |
| 3,918,202 | 11/1975 | Smith | 52/456 X |
| 4,060,950 | 12/1977 | Rackard et al. | 52/456 |
| 4,112,640 | 9/1978 | Reifsynyder . | |
| 4,785,603 | 11/1988 | Platt | 52/667 |
| 4,845,911 | 7/1989 | Winston et al. | 52/456 |
| 4,860,517 | 8/1989 | Kipross | 52/456 X |
| 4,903,444 | 2/1990 | Berndt . | |
| 4,970,840 | 11/1990 | Ovellette et al. | 52/456 X |
| 5,088,255 | 2/1992 | Emanuel | 52/456 X |
| 5,133,123 | 7/1992 | Rigg . | |
| 5,137,390 | 8/1992 | Felsen | 52/667 X |
| 5,291,710 | 3/1994 | Golen | 52/456 X |
| 5,351,459 | 10/1994 | Kassl et al. | 52/456 X |

FOREIGN PATENT DOCUMENTS

| | | |
|---|---|---|
| 8607012 | 4/1986 | Germany . |
| 01710 | 11/1911 | United Kingdom . |
| 535307 | 4/1941 | United Kingdom . |
| 9413920 | 6/1994 | WIPO . |

*Primary Examiner*—Wynn E. Wood

*Attorney, Agent, or Firm*—Ostrolenk, Faber, Gerb & Soffen, LLP

[57] ABSTRACT

A cruciform joint of glazing bars comprising a glazing bar extending between and perpendicular to an aligned pair of glazing bars. Each glazing bar has a central load bearing portion (16) which has a solid snapfit formation (22) at one end, interconnected to a solid end portion (23) by a hollow mid-portion (21). A base portion is interlocked with the solid end portion (23) and a clamping section is snap-fitted onto the snap-fit formation (22) so that a respective pane of glazing material can be clamped therebetween. The aligned pair of glazing bars are connected by a key (19) which is placed through a keyhole (18) in the intervening glazing bar and which extends into the hollow mid-portions (21) of each of the aligned pair. The keyhole (18) is formed solely through the hollow mid-portion (21) of the glazing bar, and the key (19) is inserted through the aperture (18) and then rotated and snap-fitted into a locked setting.

9 Claims, 3 Drawing Sheets

CRUCIFORM JOINT OF GLAZING BARS

This invention relates to a cruciform joint of glazing bars. The invention has particular application to a cruciform joint of glazing bars intended to simulate a traditional Georgian-type window. It is applicable to doors as well as to windows. This invention is concerned with improvements in, developments or modifications of the grid structures that form the subject of my International Patent Publication No. WO94/13920.

My International Patent Publication WO94/13920describes a grid of mutually perpendicular glazing bars comprising at least one glazing bar extending between and substantially perpendicular to an aligned pair of glazing bars. Each glazing bar in the grid has a central load bearing portion, a base portion, which projects from either side of the central portion to provide a seat for a pane of glazing material, and a clamping section. The central portion has a snap fit formation at a location which is spaced from the base portion. The clamping section is adapted to be releasably snap fitted onto the formation to clamp a respective pane of glazing material on each of the seats. Locating means are embedded in the adjacent ends of the bars of the aligned pair and extend therebetween through the intervening glazing bar to locate the aligned pair of glazing bars substantially relative to one another. The central load bearing portion and the base portion of each bar are interlocked. The snap-fit formation is solid, and formed at an outer end of the central load bearing portion and extends outwardly beyond a respective pane of glazing material that is clamped on the seat when the grid structure is glazed. The end portion at the other end of each central load bearing portion extends outwardly beyond the seat and is also solid. The snap fit formation and the end portion at the other end are interconnected by a mid-portion which is hollow and extends substantially symmetrically about the longitudinally extending neutral axis of the central load bearing portion. The locating means embedded in the adjacent ends of the aligned pair of glazing bars are received within the interior of the hollow load bearing portions thereof. The cross-section of the central load bearing portion, which is a form of beam analogous to an I-section beam, maximises the geometrical moment of inertia thereof so that the grid structure has substantial strength such as to withstand considerable wind loads and other loads (such as those due to a person either deliberately pushing or accidentally falling against the grid) to which it may be subjected when installed.

DE-U-8607012.6 discloses the use of a linking plate which is engaged in the hollow interior of an aligned pair of glazing bars and which extends through a slot formed from one end in an intervening glazing bar which is normal to the aligned pair.

According to the present invention there is provided a cruciform joint of glazing bars comprising one intervening glazing bar extending between and substantially perpendicular to an aligned pair of glazing bars, and a linking plate which has two ends, and which is fitted at either end in a respective one of the aligned pair of glazing bars, and which extends therebetween through a lateral aperture in the intervening glazing bar to locate the aligned pair of glazing bars substantially relative to one another and the intervening glazing bar, wherein part of the lateral aperture forms snap-fit locating means for the linking plate which comprises a key, the linking plate and the lateral aperture being such that the linking plate is operable to be inserted through the lateral aperture and, when so inserted, to be rotated until snap-fitted into the snap-fit locating means, the cruciform joint being formed when the linking plate is snap-fitted into the snap-fit locating means.

Preferably each of the glazing bars comprises a central load bearing portion, a base portion and a clamping section, the central load bearing portion having a solid formation at one end and a solid end portion at another end, the solid formation and end portion being interconnected by a hollow mid portion whereby the central load bearing portion has a form analogous to an I-section beam, the base portion being interlocked with the end portion and projecting from either side of the central load bearing portion to provide a seat for a pane of glazing material on either side of the central load bearing portion, and the clamping section being adapted to be fitted onto the formation to clamp a respective pane of glazing material on each of said seats.

Preferably the lateral aperture is formed solely through the hollow mid portion of the central load bearing portion of the intervening glazing bar.

Preferably the formation is a snap fit formation onto which the clamping section is snap fitted. The snap-fit formation may comprise a domed arrow head. The domed arrow head may have a substantially semi-circular leading edge and a symmetrically disposed pair of barbs spaced from the tip of the leading edge substantially by the diameter of the leading edge. The central load bearing portion and the base portion may be interlocked by each having at least one flange portion that is formed on it fitted snugly into a respective recess or aperture formed in the other of the central load bearing portion and the base portion.

The linking plate is preferably formed with protuberances on its edges which form locating abutments to locate the linking plate relative to the intervening glazing bar.

The linking plate is preferably formed with protuberances on its edges which form locating abutments to locate the aligned pair of glazing bars relative to the intervening glazing bar.

The improvements, developments or modifications that form the subject of this application are described now by way of example with reference to the accompanying drawings, of which:

FIG. 1 shows a window of the Georgian style. It comprises an outer rectangular frame 10 and peripheral beading 11 both formed of uPVC extrusions.

Figure 2:
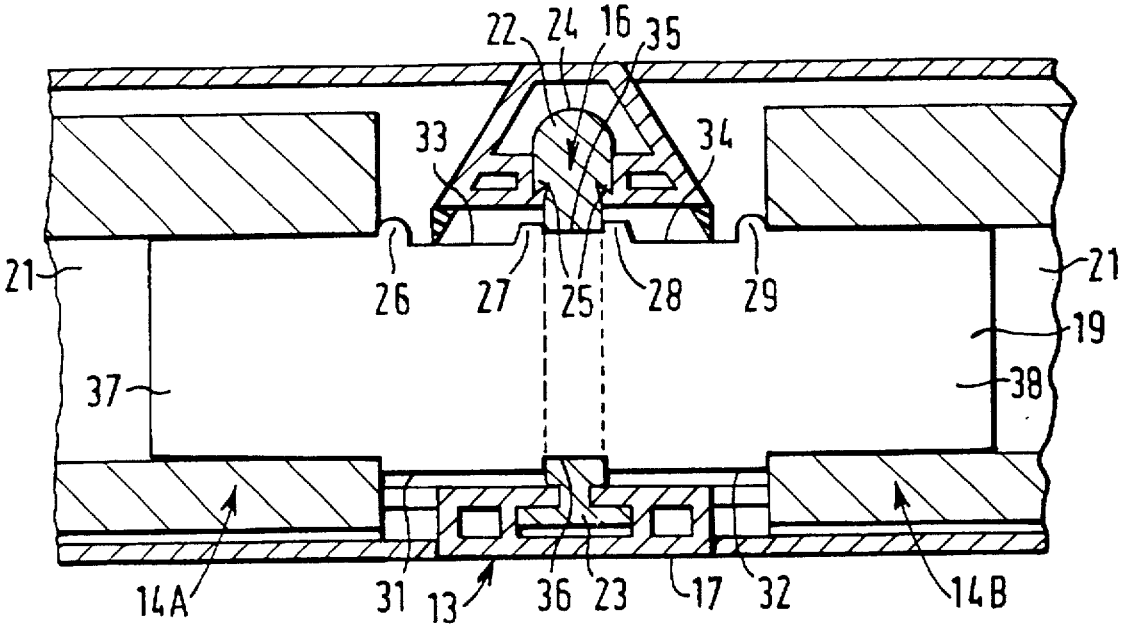
FIG. 2 is a section through a cruciform joint in the Georgian type window grid structure shown in FIG. 1, the section being on the line II—II in FIG. 1.

The rectangular aperture formed by the frame 10 is divided into smaller rectangular apertures for individual panes 12 of glass by vertical glazing bars 13, which extend from the top to the bottom of the frame 10, and by horizontal rows of aligned shorter glazing bars 14A–14C. Each vertical glazing bar 13 extends between and is perpendicular to an aligned pair 14A and 14B, 14B and 14c of the shorter glazing bars to form a cruciform joint. Each glazing bar 13,14A,14B,14C carries its own beading cap 15 which is fitted onto the remainder of the respective glazing bar as shown in FIG. 2. Mitered joints are formed at the junction of the peripheral beading 11 with an end of a respective one of both the vertical glazing bars 13 and the outer horizontal glazing bars 14A and 14C, in much the same way as they are formed between the strips of peripheral beading 11 at each corner of the frame 10.

Suitable fixing means are provided at each junction between the frame 10 and an end of a glazing bar 13,14A, 14C.

Each pane 12 of glass to be fitted into one of the smaller rectangular apertures may be either a single pane of glass or a multiple glazed unit.

Figure 3:
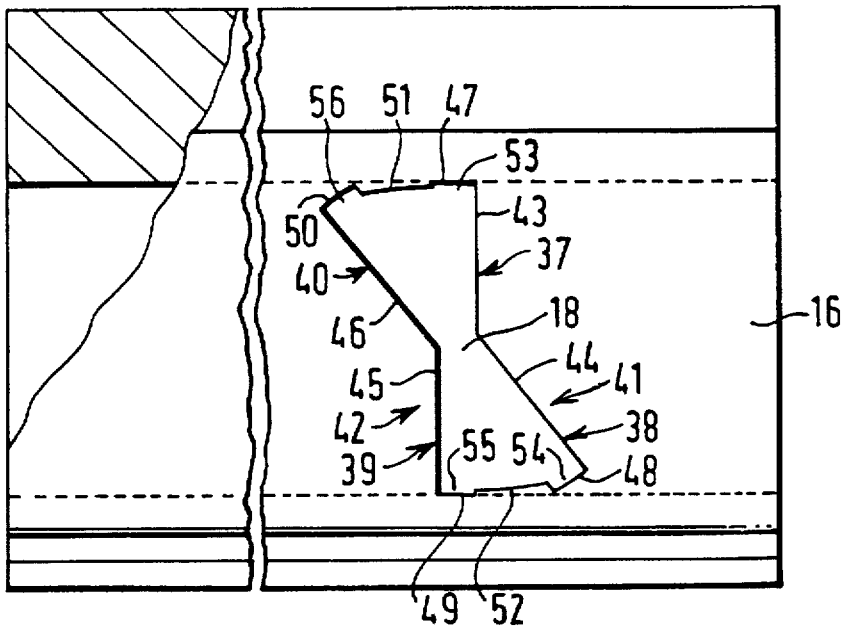
FIG. 3 is a side view of a component of the cruciform joint shown in FIG. 2, part of the component being broken away; and, FIG. 4 illustrates assembly of components of the cruciform joint shown in FIG. 1.
Figure 4:
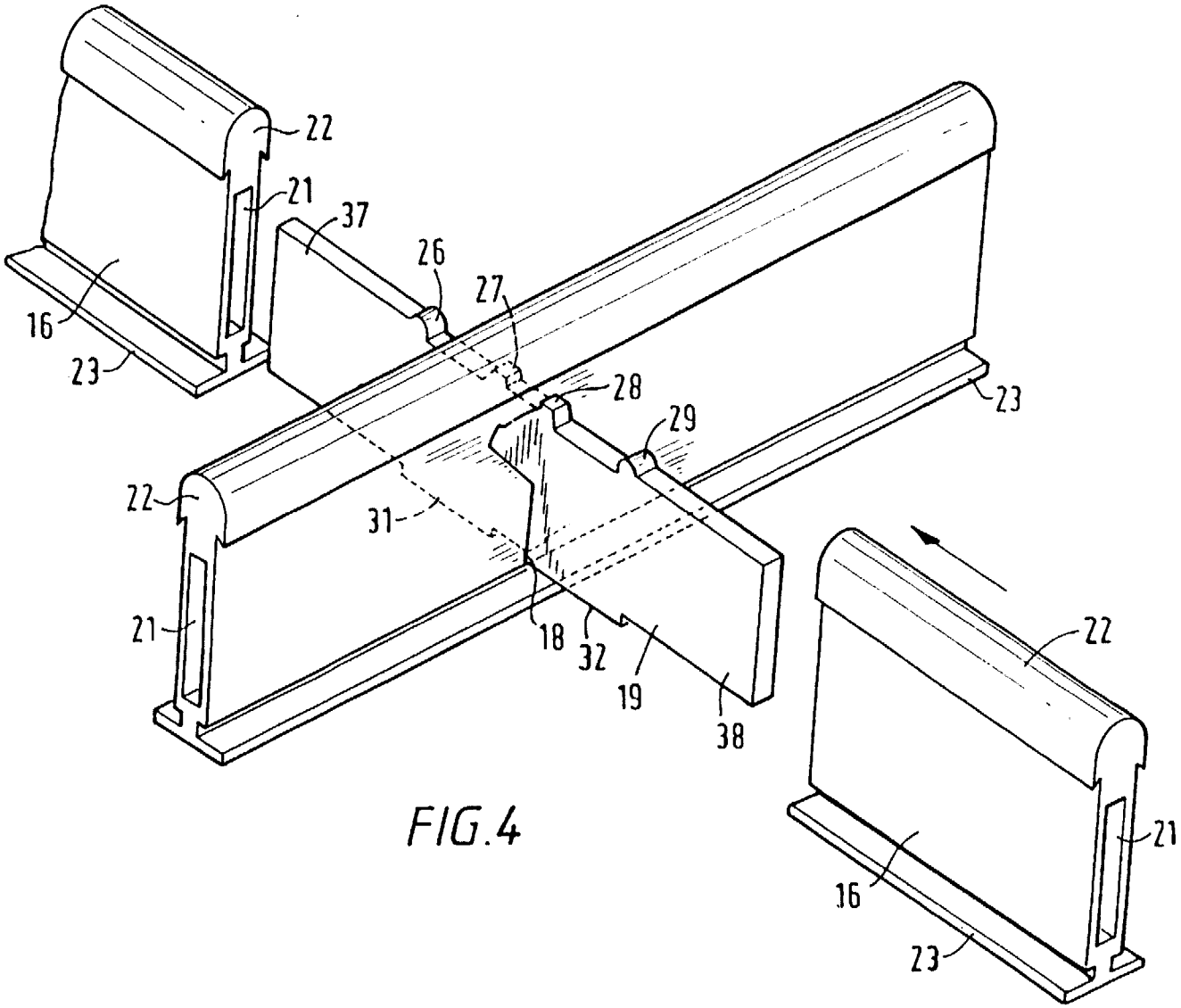

FIGS. 2 to 4 show how a cruciform joint of glazing bars 13 and 14A, 14B or 14C is assembled.

Figure 1:
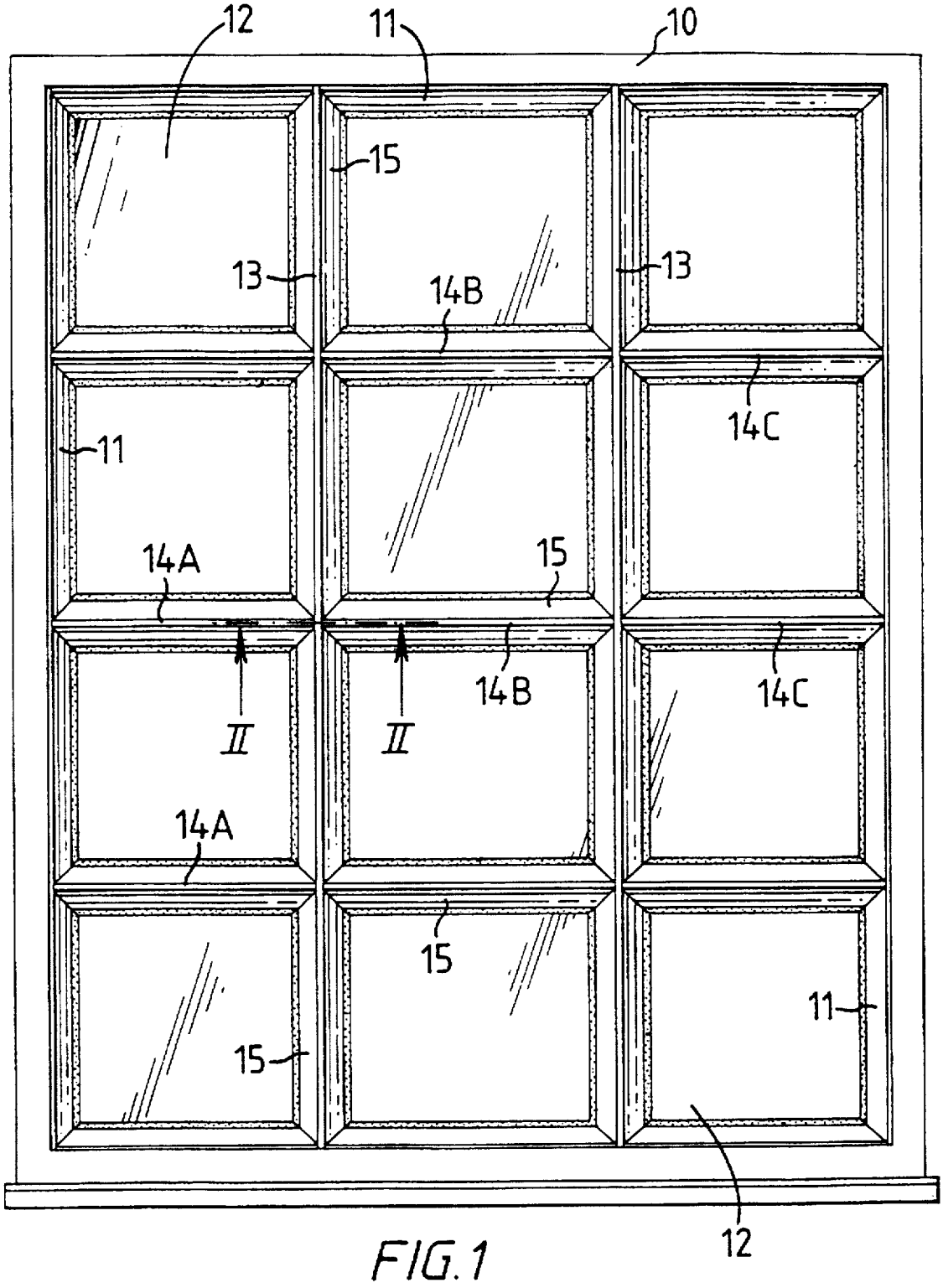
FIG. 1 is a front elevation of a Georgian-type window.

FIG. 2 shows that each glazing bar 13,14A,14B,14C comprises a central load bearing component 16 which is a hollow extrusion and which is interlocked at one end with another extrusion 17 of a plastics material so that the interlocked extrusions together have the form of a T (see FIG. 2). The component 16 and the other extrusion 17, which forms a base portion, are interlocked by each having flanges formed symmetrically on it, fitted snugly into a respective recess or aperture formed in the other. The central load bearing component 16 of each vertical and each horizontal glazing bar 13,14A,14B,14C has the same uniform cross-section, but that of each vertical glazing bar 13 is formed with a lateral aperture in its hollow mid-portion at each cruciform joint. Although only one lateral aperture 18 is shown in FIG. 2, it will be understood from FIG. 1 that each vertical glazing bar 13 has a number of such lateral apertures (three in the illustrated example) at spaced intervals along its length. The central load bearing components 16 of each aligned pair of horizontal glazing bars 14A and 14B, 14B and 14C, are joined together by a linking plate 19 which is spigotted into each of them and which extends through the respective lateral aperture 18 of the intervening vertical glazing bar 13. The linking plate 19 functions as a key. The lateral aperture 18 is a keyhole into which the linking plate 19 can be inserted and which has a snap-fit locking location into which the key 19 can be snap-fitted.

FIG. 3 shows part of a hollow elongate metal component which has been cut to length from an extrusion for use as a central load bearing component 16 of a vertical glazing bar. FIG. 4 shows that it has a rectangular cavity 21 extending along a longitudinal axis, from end to end thereof, a solid longitudinally extending snap-fit formation 22 and a solid longitudinally extending base portion 23. The cavity 21 is the hollow of the hollow mid-portion which joins the solid snap-fit formation 22 to the solid base portion 23, the resultant component having a form which is analogous to an I-section beam. The snap-fit formation 22 is shaped like a domed arrow head, with a substantially semi-circular leading edge 24 and a symmetrically disposed pair of barbs 25 spaced from the tip of the leading edge 24 substantially by the diameter of the leading edge 24. Each keyhole 18 extends through the component 16 perpendicular to the longitudinal axis thereof.

The key 19 comprises a generally rectangular plate which has four protuberances 26, 27, 28 and 29, spaced along one edge and two projections 31 and 32 spaced along the opposite edge. Each projection 31,32 is opposite a respective recess 33,34 between the two of the protuberances 26 and 27, 28 and 29 that are nearest to the nearer of the ends of the key 19. An opposed pair of locking recesses 35 and 36 are formed between the middle two protuberances 27 and 28 and the projections 31 and 32 respectively. The width of each of the end portions 37 and 38 of the key 19, outwith the region where the protuberances 26 to 29 and projections 31 and 32 are formed, is such that each of them can be inserted into the respective cavity 21 formed in the respective aligned component 16. The adjacent protuberances 26 and 29 and the projections 31 and 32 serve as stops limiting the insertion of the key 19, so that only the end portions 37 and 38 of the key 19 can be inserted in the cavities 21 respectively.

FIG. 3 shows that the shape of the keyhole 18 is partially defined by four L-shaped pairs of edges 37 to 40 arranged in two opposed pairs 41 and 42. The longer edges 43 and 44, 45 and 46 of each opposed pair 41,42 meet at their ends remote from their respective shorter edges 47 and 48, 49 and 50. The shorter edges 47 and 48, 49 and 50 of each opposed pair 41,42 extend towards the respective shorter edges 50 and 49,48 and 47 of the other opposed pair 41,42 and the opposed longer edges 43 and 46, 44 and 45 of each opposed pair 41,42 diverge away from their meeting ends towards their respective shorter edges 47 and 50, 48 and 49. Each opposed pair 41,42 has one L-shaped pair 38,40, the longer edges 44 and 46 of which are slightly longer than the corresponding longer edges 43 and 45 of the other L-shaped pair 37,39. The arrangement of the opposed pairs 41 and 42 is such that the L-shaped pairs 38 and 40 with the longer edges 44 and 46 face the respective pairs 39 and 37 with the shorter edges 45 and 43. The longer of the longer edges 44 and 46 of the opposed pairs 41 and 42 are substantially parallel, as are the other longer edges 43 and 45.

Each of the ends of the shorter edges 47 to 50 remote from the respective longer edges 43 to 46 is joined to the nearer of those ends by a respective ramp edge 51,52 which is stepped from the ends of each of the shorter edges 47 and 50, 48 and 49 which it joins so that four grooves 53 to 56 are formed, each of which is defined in combination by a step, one of the shorter edges 47 to 50 and its adjacent longer edge 43 to 46. The grooves 53 and 55 are defined in combination with the edges of the L-shaped pairs 37, 39 which have the shorter edges. The grooves 54 and 56 are defined in combination with the edges of the L-shaped pairs 38,40 which have the longer edges. The arrangement is such that grooves 53 and 54 are directly opposite grooves 56 and 55 respectively.

The position of the keyhole 18 in the component 16 is such that the planes which contain all of the edges which define the keyhole 18 extend through sidewalls only of the rectangular cavity 21 in the component 16. Hence the keyhole 18 is formed solely in the hollow mid-portion of the component 16 and does not extend into the solid outer end portions 16 and 23. The meeting ends of the long edges 43 and 44, and 45 and 46 of the opposed pairs 41 and 42 meet on a plane of symmetry of the rectangular cavity 21, the plane of symmetry being parallel to the short edges of the cavity 21.

Having the keyhole 18 formed solely through the cavity 21 is advantageous because it does not significantly reduce the overall strength of the central load bearing component 16 which is analogous to an I-beam.

The relative dimensions of the key 19 and the keyhole 18 are such that the width of the key 19 between the opposed locking recesses 35 and 36 is less than the distance between the short edges 48 and 50 at the ends of the longer edges 44 and 46, but slightly greater than the distance between the ends of the ramps 51 and 52 nearest the grooves 53 and 55 respectively. The short edges 48 and 50 at the ends of the longer edges 44 and 46 are spaced apart sufficiently to provide clearance for the protuberances 26 to 29 and the projections 31 and 32, allowing the key 19 to be inserted into the grooves 54 and 56. When the key 19 is in a locked position in the keyhole 18, it is a tight fit in the grooves 53 and 55.

The key 19 can be locked in the keyhole 18 so that it is held securely relative to the component 16 through which it extends laterally. The key 19 is placed through the keyhole 18 so that initially the opposed locking recesses 35 and 36 are aligned with the grooves 54 and 56 respectively. The key 19 is then rotated until the opposed locking recesses 35 and 36 are aligned with the grooves 53 and 55 respectively. Since the width of the key 19 between the opposed locking recesses 35 and 36 is slightly greater than the distance between the ends of the ramps 51 and 52 nearest the grooves 53 and 55 of the keyhole 18, the keyhole 18 provides a snap-fit locking location, so that when the key 19 is rotated from its initial position in the keyhole 18, it is snap-fitted into the grooves 53 and 55.

When locked into the component 16 through which it extends laterally, the key 19 is perpendicular to a longitudinal plane of symmetry of that load bearing component 16, the middle pair of protuberances 27 and 28 and the projections 31 and 32 abut outer faces of that component 16 and the outer pair of protuberances 26 and 29 are on a respective part of the key 19 that extends beyond that load bearing component 16.

As shown in FIGS. 2 and 4, the key 19 is used to locate the aligned components 16 of the pair of horizontal glazing bars 14A and 14B on either side of the vertical glazing bar 13. The aligned components 16 are positioned so that they can be fitted onto the key 19, as shown in FIG. 4, with the outer protuberances 26 and 29 and the projections 31 and 32 abutting and thereby locating the aligned components 16.

The use of the key 19 when it is snap fitted into a locked setting in the keyhole simplifies the assembly of the cruciform joint, as the aligned components 16 are accurately positioned relative to the intervening glazing bar 13 merely by placing them on the key 19. There is no need for any further alignment of the components 13 and 16 relative to each other. This makes the assembly of a grid, such as that shown in FIG. 1, much simpler. The assembly of the cruciform joint is further simplified by the provision of the outer protuberances 26 and 29 and the projections 31 and 32 which act as stops limiting the insertion of the ends 37 and 38 of the key 19 into the hollow mid-portions of the aligned components 16. This is because the widths of the recesses 33 and 34 formed between pairs of the protuberances 26 and 27, 28 and 29, and the widths of the projections 31 and 32 are such that beading 15, and a length of plastics extrusion 17 can be fitted onto the component 13, as described above, after the assembly of a cruciform joint of the components 13 and 16.

The use of the key 19 also makes the length to which the aligned components 16 are cut to fit into a grid less critical, since the ends 37 and 38 of the key 19 extend into the hollow mid-portions of the aligned components 16 in such a way that it is possible to move the components 16 along the ends 37 and 38.

When a grid, assembled using cruciform joints of glazing bars in which the present invention is embodied, is used to form say a window, it is not important from a structural point of view which of the beading cap 15 or the base portion 13 is on the external or internal side of the window. Either of the beading cap 15 or the base portion 13 may be on either of the internal or the external side without any detrimental effect on the strength or the functionality of the glazing bar. Alternatively, two beading caps could be provided, one of which could be snap-fitted onto the component 16, the other of which could be interlocked with the base portion of the component 16.

We claim:

1. A cruciform joint of glazing bars (13,14A,14B,14C) comprising one intervening glazing bar (13) extending between and substantially perpendicular to an aligned pair of glazing bars (14A and 14B, 14B and 14C), and a linking plate (19) which has two ends (37 and 38), which is fitted at either end (37,38) in a respective one of the aligned pair of glazing bars (14A and 14B, 14B and 14C), and which extends therebetween through a lateral aperture (18) in the intervening glazing bar (13) to locate the aligned pair of glazing bars (14A and 14B, 14B and 14C) substantially relative to one another and the intervening glazing bar (13), characterised in that part of the lateral aperture (18) forms snap-fit locating means (53 and 55) for the linking plate (19) which comprises a key, the linking plate (19) and the lateral aperture (18) being such that the linking plate (19) is operable to be inserted through the lateral aperture (18) and, when so inserted, to be rotated until snap-fitted into the snap-fit locating means (53 and 55), the cruciform joint being formed when the linking plate (19) is snap-fitted into the snap-fit locating means (53 and 55).

2. A cruciform joint of glazing bars (13, 14A, 14B, 14C) comprising one intervening glazing bar (13) extending between and substantially perpendicular to an aligned pair of glazing bars (14A and 14B, 14B and 14C), and a linking plate (19) which had two ends (27 and 38), which is fitted at either end (37, 38) in a respective one of the aligned pair of glazing bars (14A and 14B, 14B and 14C), and which extends therebetween through a lateral aperture (18) in the intervening glazing bar (13) to locate the aligned pair of glazing bars (14A and 14B, 14B and 14C) substantially relative to one another and the intervening glazing bar (13), characterised in that part of the lateral aperture (18) forms snap-fit locating means (53 and 55) for the linking plate (19) which comprises a key, the linking pate (19) and the lateral aperture (18) being such that the linking plate (19) is operable to be inserted through the lateral aperture (18) and, when so inserted, to be rotated until snap-fitted into the snap-fit locating means (53 and 55), the cruciform joint being formed when the linking plate (19) is snap-fitted into the snap-fit locating means (53 and 55), wherein each of the glazing bars (13, 14A, 14B, 14C) comprises a central load bearing portion (16), a base portion (17) and a clamping section (15), the central load bearing portion (16) having a solid formation at one end and a solid end portion (23) at another end, the solid formation (22) and end portion (23) being interconnected by a hollow mid portion whereby the central load bearing portion (16) has a form analogous to an I-section beam, the base portion (17) being interlocked with the end portion (23) and projecting from either side of the central load bearing portion (16) to provide a seat for a pane (12) of glazing material on either side of the central load bearing portion (16), and the clamping section (15) being adapted to be fitted onto the formation (22) to clamp a respective pane (12) of glazing material on each of said seats.

3. A cruciform joint according to claim 2, wherein the lateral aperture (18) is formed solely through the hollow mid portion (21) of the central load bearing portion (16) of the intervening glazing bar (13).

4. A cruciform joint according to claim 2, wherein the formation (22) of each glazing bar (13, 14A, 14B, 14C) is a snap-fit formation onto which the respective clamping section (15) is snap-fitted.

5. A cruciform joint according to claim 4, wherein the snap-fit formation (22) comprises a domed arrowhead.

6. A cruciform joint according to claim 5, wherein the domed arrowhead has a substantially semi-circular leading edge and a symmetrically disposed pair of barbs spaced from the tip of the leading edge substantially by the diameter of the leading edge.

7. A cruciform joint according to claim 2 wherein the central load bearing portion (16) and the base portion (17) are interlocked by each having at least one flange portion that is formed on it, fitted snugly into a respective recess or aperture formed in the other of the central load bearing portion (16) and the base portion (17).

8. A cruciform joint according to claim 1 wherein the linking plate (19) is formed with protuberances (27 and 28, 31 and 32) on its edges which form locating abutments to locate the linking plate (19) relative to the intervening glazing bar (13).

9. A cruciform joint according to claim 1 wherein the linking plate (19) is formed with protuberances (26 and 31, 32 and 27) on its edges which form locating abutments to locate the aligned pair of glazing bars (14A and 14B, 14B and 14C).

* * * * *